US009599391B2

(12) United States Patent
Gultekin et al.

(10) Patent No.: US 9,599,391 B2
(45) Date of Patent: Mar. 21, 2017

(54) COOLING DEVICE COMPRISING A PIPE RETAINER

(75) Inventors: Ozgun Atac Gultekin, Istanbul (TR); Fatih Demiray, Istanbul (TR); Musa Caliskan, Istanbul (TR); Murat Ungor, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 695 days.

(21) Appl. No.: 13/977,712

(22) PCT Filed: Dec. 7, 2011

(86) PCT No.: PCT/EP2011/072115

§ 371 (c)(1),
(2), (4) Date: Nov. 26, 2013

(87) PCT Pub. No.: WO2012/089475

PCT Pub. Date: Jul. 5, 2012

(65) Prior Publication Data

US 2014/0174119 A1 Jun. 26, 2014

(30) Foreign Application Priority Data

Dec. 29, 2010 (TR) ..... a 2010 11103

(51) Int. Cl.
*F25D 23/06* (2006.01)
*F25D 23/00* (2006.01)

(52) U.S. Cl.
CPC ..... *F25D 23/006* (2013.01); *F25D 23/067* (2013.01); *F25D 23/061* (2013.01)

(58) Field of Classification Search
CPC ..... F25D 23/06; F25D 23/061; F25D 23/068; F25D 23/067
See application file for complete search history.

(56) References Cited

FOREIGN PATENT DOCUMENTS

JP 2003075057 A * 3/2003
TR WO 2009019268 A2 * 2/2009 ..... F25D 23/068

OTHER PUBLICATIONS

Translation of JP 2003075057 A.*
Translation of WO 2009019268 A2.*

* cited by examiner

*Primary Examiner* — Elizabeth Martin
(74) *Attorney, Agent, or Firm* — Kilpatrick Townsend & Stockton LLP

(57) ABSTRACT

A cooling device (1) is describe having a refrigeration volume (3) wherein the foodstuffs to be cooled are placed, at least one cabinet (2) having an inner wall (4) surrounding the refrigeration volume (3) and an outer wall (5) with heat insulating material injected between itself and the inner wall (4), a compressor (6) providing compression of the refrigerant and circulation pipes (7) that extend at least between the inner wall (4) and the outer wall (5), providing the refrigeration volume (3) to be cooled by circulating the refrigerant leaving the compressor (6) therein.

17 Claims, 5 Drawing Sheets

COOLING DEVICE COMPRISING A PIPE RETAINER

Figure 1:
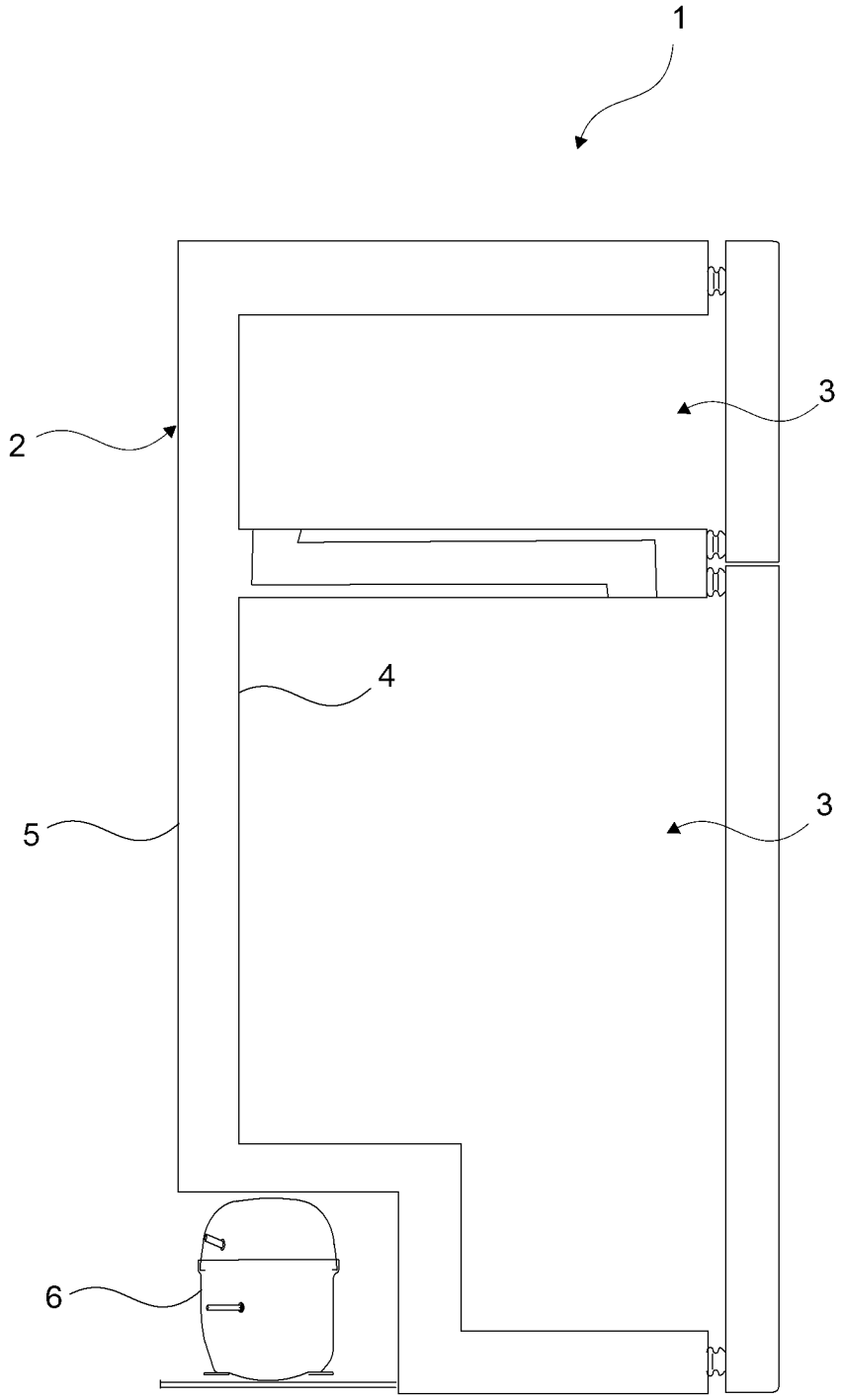

The present invention relates to a cooling device that comprises a retainer for holding the circulation pipes.

In cooling devices the cabinet, wherein the refrigeration process is performed, is produced by the method of injecting the heat insulating material between an inner wall and outer wall. The circulation pipes wherein the refrigerant used in the refrigeration cycle is circulated extend between the inner wall and the outer wall. There are differences between the temperature of the fluid circulating inside the circulation pipes and the temperature of the outside environment or the interior of the cabinet. Therefore, when the circulation pipes contact the inner wall and the outer wall, condensation, perspiration develops on the inner wall and the outer wall respectively. Development of perspiration both on the inner wall and the outer wall causes annoyance in terms of the user. Furthermore, the development of condensation on the inner walls cause the foodstuffs placed inside the cabinet to spoil faster.

In the state of the art Japanese Patent Application No. JP2003065657, a refrigerator is described that comprises a cushion member disposed between the inner wall and the outer wall which is used for retaining the pipes wherein the refrigerant is circulated.

In another state of the art embodiment, Patent Application No. JP6159918, a refrigerator is described comprising more than one pipe retainer for holding the heating pipes which are disposed for preventing dewing on the intermediary partition.

The aim of the present invention is the realization of a cooling device wherein development of condensation is prevented on the inner wall and the outer wall.

The cooling device realized in order to attain the aim of the present invention, explicated in the first claim and the respective claims thereof, comprises at least one inner wall surrounding the refrigeration volume, at least one outer wall with heat insulating material injected in between the inner wall and itself, and circulation pipes that extend between the inner wall and the outer wall, wherein the refrigerant used in the refrigeration cycle is circulated. The cooling device furthermore comprises at least one retainer, providing the circulation pipes to be held between the inner wall and the outer wall, having a body wherein the circulation pipe is disposed, an inlet port located on the body, enabling the circulation pipe to be placed into the body, more than one first arm, extending from the body towards the circulation pipe and at least two second arms, each one extending from the body towards the inner wall and the outer wall respectively. The circulation pipe is inserted through the inlet port and held between the first arms. Thus, the circulation pipe is prevented from contacting the inner wall and the outer wall. Consequently, condensation is prevented from developing on the inner wall and the outer wall by minimizing the heat transfer between the inner wall and the outer wall.

In an embodiment of the present invention, the body is configured in hollow cylindrical shape to match the configuration of the circulation pipe. The circulation pipe is disposed almost at the middle of the body. The circulation pipe is provided to be held by the first arms in a balanced manner by means of the lengths of the first arms being almost equal to one another.

In a version of this embodiment, the lengths of the second arms are almost equal to one another.

The distance between the center of the circulation pipe, and the inner wall and the outer wall is equal to the radius of the imaginary circle passing from the ends of the second arms contacting with the inner wall and the outer wall.

In another embodiment of the present invention, the inlet port is of such a configuration that the circulation pipe cannot easily be dislodged from the body after the circulation pipe is placed into the body. The circulation pipe is placed between the first arms by stretching both of the first arms on two sides of the inlet port.

In another embodiment of the present invention, the first arms disposed at two sides of the inlet port have triangular cross-sections. Thus, the first arms at two sides of the inlet port are strengthened thereby preventing problems like the circulation pipe breaking while being inserted through the inlet port.

In another embodiment of the present invention, the first arms are positioned to be spaced apart from each other on the body. The gaps remaining between the first arms are filled in with heat insulating material. Thus, the heat transfer occurring between the circulation pipe and the first arms is minimized.

In another embodiment of the present invention, the second arms are positioned to be spaced apart from each other on the body. The gaps remaining between the second arms are filled in with heat insulating material. Thus, the heat transfer between the second arms, and the inner wall and the outer wall is decreased.

In another embodiment of the present invention, the second arms are so configured as to narrow while extending from the body towards the inner wall or the outer wall. Thus, the contact surface of the second arms with the inner wall and the outer wall is downsized. Consequently, the heat transfer occurring between the retainer and the inner wall and the outer wall is minimized.

In another embodiment of the present invention, supports are provided on the outer periphery of the body, each extending between both arms. Thus, the strength of the retainer is increased, preventing damaging of the second arms particularly while injecting heat insulating material between the inner wall and the outer wall.

In another embodiment of the present invention, the retainer is produced from plastic. Thus, the retainer gains flexibility and placing the circulation pipe into the retainer becomes easier.

By means of the present invention, the heat transfer that may occur between the circulation pipes, and the inner wall and the outer wall is minimized by preventing the circulation pipes from contacting the inner wall and the outer wall. Accordingly, the development of condensation, perspiration on the inner wall and the outer wall is prevented.

A cooling device realized in order to attain the aim of the present invention is illustrated in the attached figures, where:

FIG. 1—is the schematic view of a cooling device.

Figure 2:
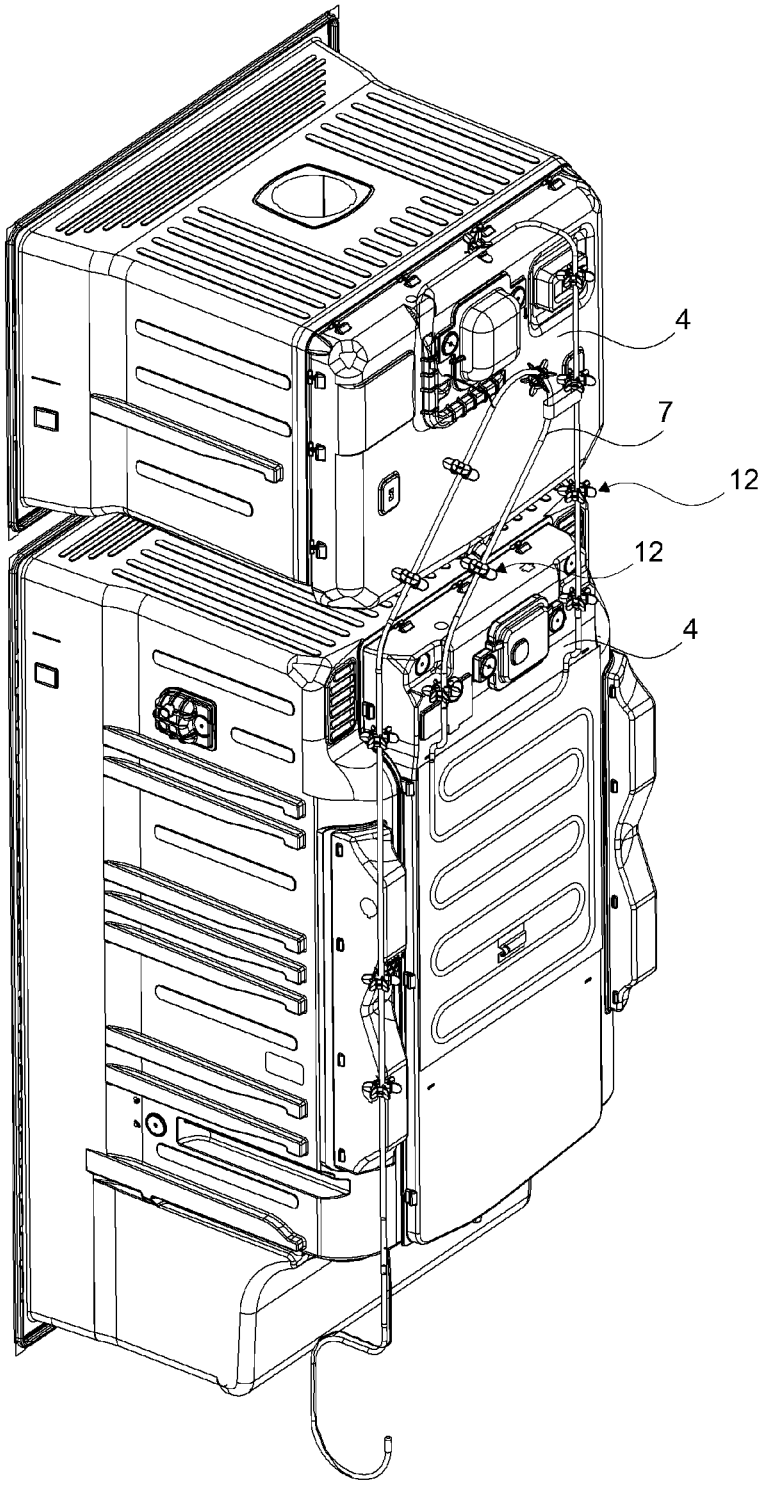

FIG. 2—is the perspective view of the inner wall, the circulation pipes and the retainers.

Figure 3:
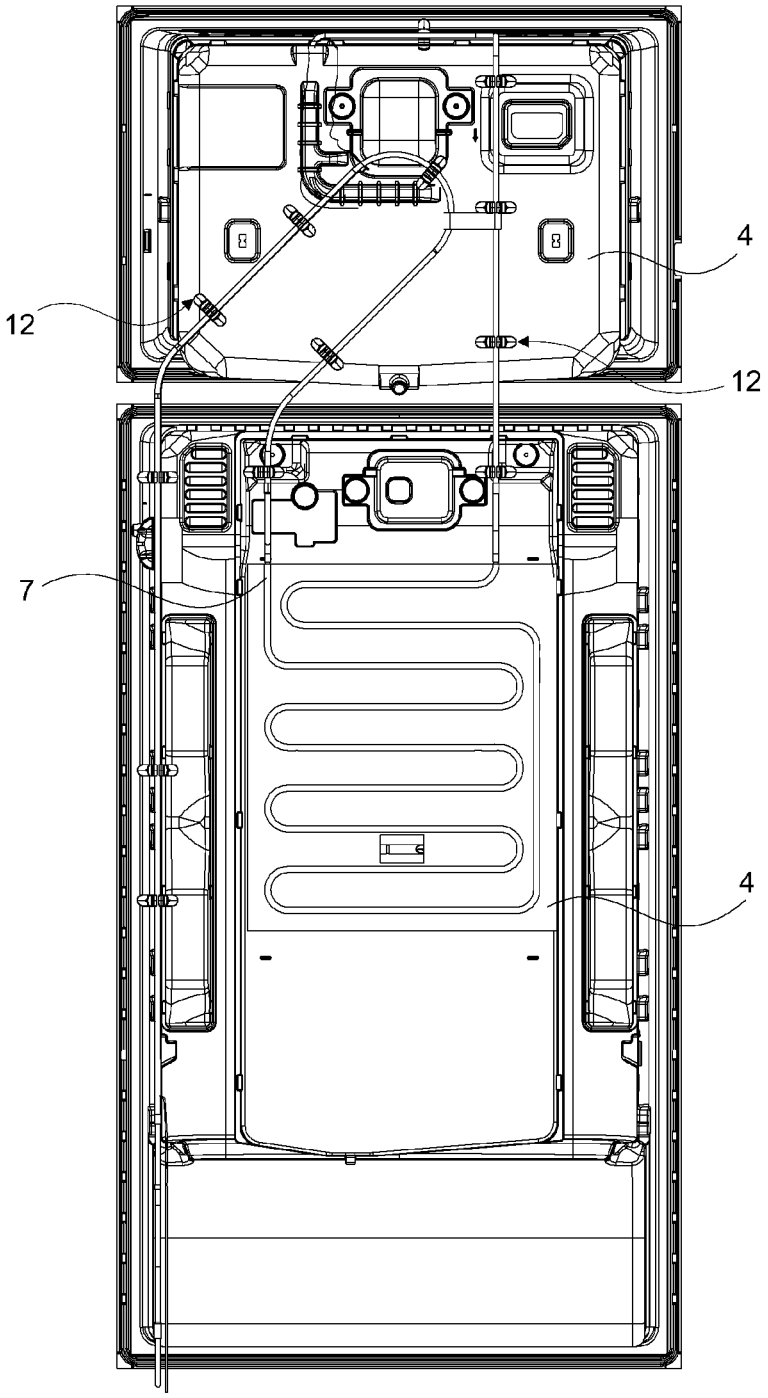

FIG. 3—is the rear view of the inner wall, the circulation pipes and the retainers.

Figure 4:
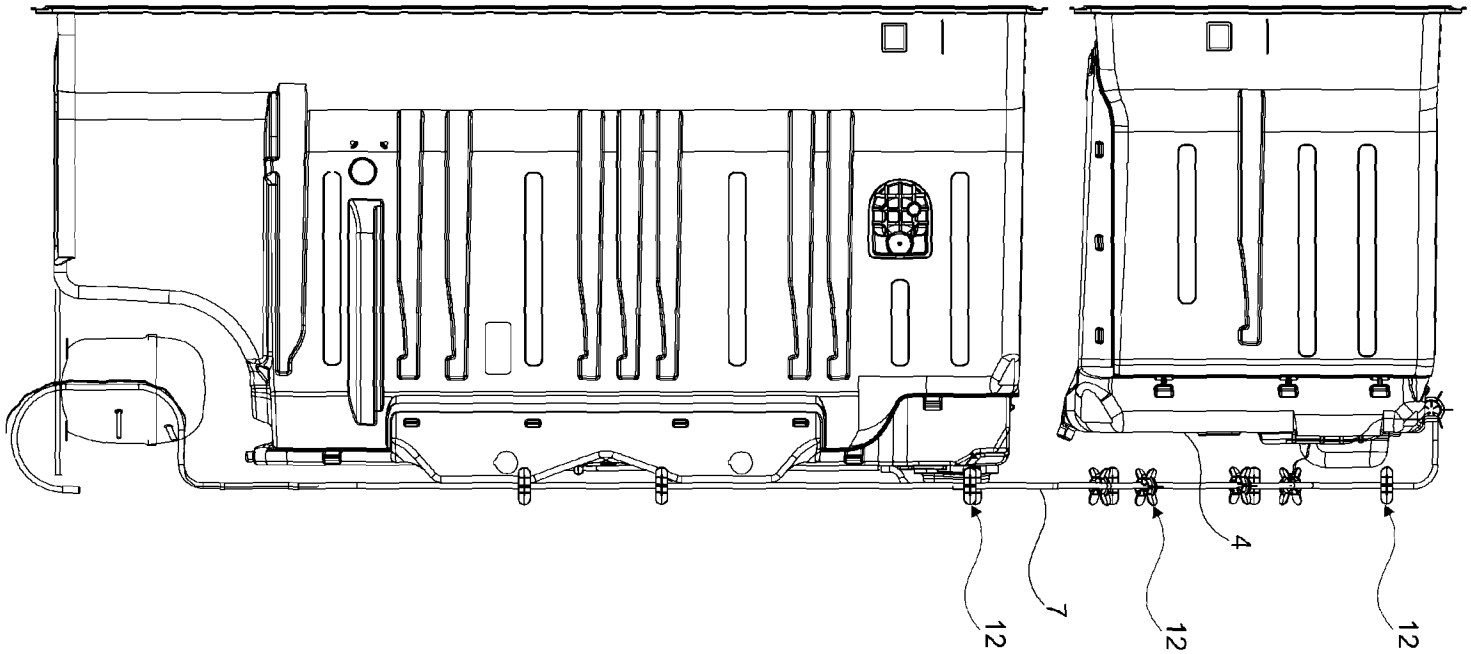

FIG. 4—is the sideways view of the inner wall, the circulation pipes and the retainers.

Figure 5:
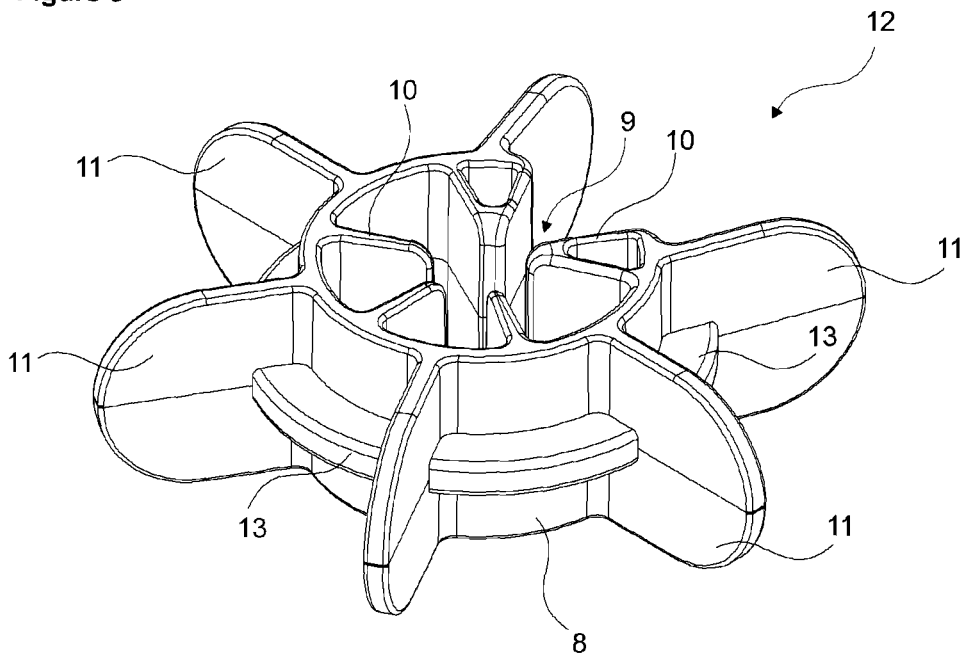

FIG. 5—is the perspective view of a retainer.

Figure 6:
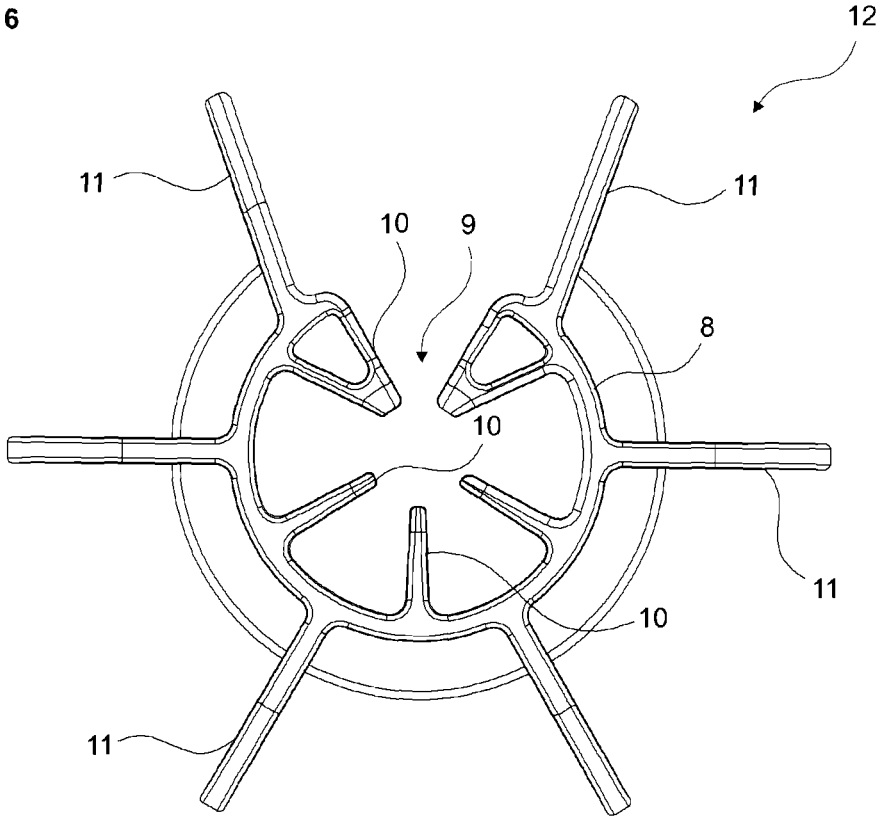

FIG. 6—is the top view of a retainer.

The elements illustrated in the figures are numbered as follows:

1. Cooling device
2. Cabinet
3. Refrigeration volume
4. Inner wall
5. Outer wall 6. Compressor
7. Circulation pipe
8. Body
9. Inlet port
10. First arm
11. Second arm
12. Retainer
13. Support The cooling device (1) comprises a refrigeration volume (3) wherein the foodstuffs to be cooled are placed, at least one cabinet (2) having an inner wall (4) surrounding the refrigeration volume (3) and an outer wall (5) with heat insulating material injected between itself and the inner wall (4), a compressor (6) providing compression of the refrigerant and circulation pipes (7) that extend at least between the inner wall (4) and the outer wall (5), providing the refrigeration volume (3) to be cooled by circulating the refrigerant leaving the compressor (6) therein.

The cooling device (1) of the present invention furthermore comprises at least one retainer (12) having a body (8)

an inlet port (9) enabling the circulation pipe (7) to be placed into the body (8), more than one first arm (10), extending from the body (8) towards the circulation pipe (7), providing the circulation pipe (7) to be held inside the body (8) and at least two second arms (11) extending towards the exterior of the body (8), at least one of them contacting the inner wall (4) and at least one other contacting the outer wall (5) at least partially.

The circulation pipes (7), wherein the refrigerant compressed from the compressor (6) and used in the refrigeration cycle is conveyed, are placed between the inner wall (4) and the outer wall (5) by means of the retainers (12). The circulation pipe (7) is disposed inside the body (8) by being inserted through the inlet port (9). The first arms (10) provide the circulation pipe (7) to be held inside the body (8). During the production of the cabinet (2), the circulation pipes (7), which are disposed inside the body (8) by being seated between the first arms (10), are placed on the inner wall (4). The outer wall (5) is covered on the inner wall (4) by injecting heat insulating material such as polyurethane etc on the inner wall (4). The retainers (12) remain in the volume between the inner wall (4) and the outer wall (5) that is filled with heat insulating material. The retainer (12) while providing the circulation pipe (7) to be held between the inner wall (4) and the outer wall (5) by means of its first arms (10), provides the circulation pipe (7) not to contact with the inner wall (4) and the outer wall (5) by means of its second arms (11). The second arms (11) provide the circulation pipe (7) to move away from the inner wall (4) and the outer wall (5). The direct contact of the circulation pipe (7) with the inner wall (4) and the outer wall (5) is prevented by means of the second arms (11). Thus, the problem of condensation that may develop on the inner wall (4) and the outer wall (5) due to the difference in temperature between the circulation pipe (7), and the inner wall (4) and outer wall (5) is prevented.

In an embodiment of the present invention, the body (8) is configured as a ring. In this embodiment, the lengths of the first arms (10) extending from the body (8) towards the circulation pipe (7) are almost equal to one another. Thus, the circulation pipe (7) is provided to be held in a balanced manner inside the retainer (12) by providing equal distance to be maintained between the cylindrically shaped circulation pipe (7) and the inner periphery of the body (8).

In a version of this embodiment, the lengths of the second arms (11) extending from the body (8) towards the inner wall (4) and the outer wall (5) are almost equal to one another.

A distance is provided between the outer periphery of the circulation pipe (7) and the inner wall (4) or the outer wall (5) that is equal to the total lengths of the first arm (10) and the second arm (11). Even if the retainer (12) moves while injecting heat insulating material between the inner wall (4) and the outer wall (5), an optimum distance determined by the producer is guaranteed to remain between the circulation pipe (7) and the inner wall (4) and the outer wall (5) by means of the body (8) being ring shaped, the lengths of the first arms (10) being equal to one another and the lengths of the second arms (11) being equal to one another.

In another embodiment of the present invention, the inlet port (9) provides the circulation pipe (7), when placed into the body (8), not to be easily dislodged from the body (8). The first arms (10) disposed on both sides of the inlet port (9) stretch while the circulation pipe (7) is placed into the body (8). The inlet port (9) does not allow the circulation pipe (7) to be dislodged easily from between the first arms (10) after the circulation pipe (7) is seated between the first arms (10) with the snap fitting method. Thus, the circulation pipe (7) is provided to be held safely by the retainer (12).

In another embodiment of the present invention, the first arms (10) disposed on both sides of the inlet port (9) have triangular cross-sections. Thus, the strength of the first arms (10) on both sides of the inlet port (9) is increased. Consequently, breaking of the first arms (10) disposed near the inlet port (9) is prevented during placement of the circulation pipe (7) into the body (8).

In another embodiment of the present invention, a gap is provided between the first arms (10) so that the heat insulating material is allowed to be injected therebetween. Thus, the heat transfer occurring between the circulation pipe (7) and the first arms (10) is minimized. Accordingly, the vicinity of the circulation pipe (7) is provided to be almost entirely surrounded by heat insulating material. Thus, the amount of heat conducted from the circulation pipe (7) to the inner wall (4) and the outer wall (5) is minimized.

In another embodiment of the present invention, a gap is provided between the second arms (11) so that the heat insulating material is allowed to be filled therebetween. Consequently, the heat transfer occurring between the second arms (11) and the inner wall (4) and the outer wall (5) is minimized. The retainer (12) is provided to occupy the least amount of space between the heat insulating material since there is a gap between the second arms (11). Thus, decrease in amount of heat insulating material injected between the inner wall (4) and the outer wall (5) due to the retainer (12) is prevented and an effective heat insulation is provided between the inner wall (4) and the outer wall (5).

In another embodiment of the present invention, the second arms (11) are so configured as to narrow from the body (8) towards the outside. Thus, the contact surface of the second arms (11) with the inner wall (4) and the outer wall (5) is decreased and the heat transmission that may occur between the retainer (12) and the inner wall (4) and the outer wall (5) is minimized. Accordingly, formation of moisture on the inner wall (4) and the outer wall (5) is avoided since the heat transfer that may occur between the circulation pipe (7) and the inner wall (4) and the outer wall (5) is minimized.

In another embodiment of the present invention, the cooling device (1) comprises at least one support (13) disposed on the outer surface of the body (8) and extending between each two second arms (11). The strength of the second arms (11) is increased by means of the support (13)

and the problem of breaking of the second arms (11) during injection of heat insulating material between the inner wall (4) and the outer wall (5) is prevented.

In another embodiment of the present invention, the retainer (12) is produced from plastic. Thus, the retainer (12) gains flexibility and placing the circulation pipe (7) into the retainer (12) is facilitated. Furthermore, heat conduction from the circulation pipe (7) to the inner wall (4) and the outer wall (5) is decreased since plastic is a heat insulating material.

By means of the cooling device (1) of the present invention, formation of moisture on the inner wall (4) and the outer wall (5) is prevented by removing contact of the circulation pipe (7) with the inner wall (4) and the outer wall (5).

It is to be understood that the present invention is not limited to the embodiments disclosed above and a person skilled in the art can easily introduce different embodiments. These should be considered within the scope of the protection postulated by the claims of the present invention.

The invention claimed is:

1. A cooling device (1) comprising a refrigeration volume (3), at least one cabinet (2) having an inner wall (4) surrounding the refrigeration volume (3) and an outer wall (5) with heat insulating material injected between the outer wall and the inner wall (4), a compressor (6) providing compression of the refrigerant and circulation pipes (7) placed between the inner wall (4) and the outer wall (5), and at least one retainer (12) having a ring shaped body (8), an inlet port (9) enabling the circulation pipe (7) to be placed into the ring shaped body (8) wherein the circulation pipe (7) is coupled to the compressor for circulating refrigerant leaving the compressor to cool the refrigeration volume, more than one first arm (10), extending radially from the ring shaped body (8) towards the circulation pipe (7), providing the circulation pipe (7) to be held inside the ring shaped body (8) in a balanced manner by providing equal distance to be maintained between the cylindrically shaped circulation pipe (7) and the inner periphery of the ring shaped body (8), and at least two second arms (11) extending towards the exterior of the ring shaped body (8), at least one of the at least two second arms contacting the inner wall (4) and at least one other of the at least two second arms contacting the outer wall (5) at least partially.

2. The cooling device (1) as in claim 1, wherein the more than one first arms (10) have lengths equal to one another.

3. The cooling device (1) as in claim 2, wherein the at least two second arms (11) have lengths equal to one another.

4. The cooling device (1) as in claim 3, wherein the circulation pipe (7) has a distance between its outer periphery and the inner wall (4) or the outer wall (5) as much as the total lengths of one of the more than one first arm (10) and one of the at least two second arms (11).

5. The cooling device (1) as in claim 4, wherein the inlet port (9) of the ring shaped body is configured such that the circulation pipe cannot easily be dislodged from the ring shaped body when the circulation pipe (7) is placed inside the ring shaped body (8).

6. The cooling device (1) as in claim 5, wherein the more than one first arms comprise two first arms (10) having triangular cross-sections and disposed on both sides of the inlet port (9).

7. The cooling device (1) as in claim 6, wherein the more than one first arms (10) have a gap therebetween allowing the heat insulating material to be filled therebetween.

8. The cooling device (1) as in claim 7 wherein the at least two second arms (11) have a gap therebetween allowing the heat insulating material to be filled therebetween.

9. The cooling device (1) as in claim 8, wherein the at least two second arms (11) are configured to narrow from the ring shaped body (8) outwards.

10. The cooling device (1) as in claim 9, further comprising at least one support (13) disposed on the outer surface of the ring shaped body (8) and extending between each of the at least two second arms (11).

11. The cooling device (1) as in claim 10, wherein the retainer (12) is plastic.

12. The cooling device (1) as in claim 1, wherein the at least two second arms (11) have lengths equal to one another.

13. The cooling device (1) as in claim 1, wherein the circulation pipe (7) has a distance between its outer periphery and the inner wall (4) or the outer wall (5) as much as the total lengths of one of the more than one first arm (10) and one of the at least two second arms (11).

14. The cooling device (1) as in claim 1, wherein the inlet port (9) of the ring shaped body is configured such that the circulation pipe (7), when placed inside the ring shaped body (8), cannot be easily dislodged from the ring shaped body (8).

15. The cooling device (1) as in claim 1, wherein the more than one first arms comprise two first arms (10) having triangular cross-sections and disposed on both sides of the inlet port (9) and wherein the at least two second arms (11) are configured to narrow from the ring shaped body (8) outwards.

16. The cooling device (1) as in claim 1, wherein the more than one first arms (10) have a gap therebetween allowing the heat insulating material to be filled therebetween.

17. The cooling device (1) as in claim 1, further comprising at least one support (13) disposed on the outer surface of the ring shaped body (8) and extending between each of the at least two second arms (11).

* * * * *